US005988576A

United States Patent [19]

Ehrlich

[11] Patent Number: 5,988,576

[45] Date of Patent: Nov. 23, 1999

[54] BINDER BIN MOUNTING BRACKET

[75] Inventor: Michael F. Ehrlich, Oakmont, Pa.

[73] Assignee: Furniture Source International, Inc., New Kensington, Pa.

[21] Appl. No.: 08/550,779

[22] Filed: Oct. 31, 1995

[51] Int. Cl.[6] ..... A47B 96/06

[52] U.S. Cl. ..... 248/220.21; 248/220.22; 211/88

[58] Field of Search ..... 248/220.21, 220.22, 248/220.31, 221.11; 211/88, 94, 103; 403/362

[56] References Cited

U.S. PATENT DOCUMENTS

| | | | |
|---|---|---|---|
| 2,336,604 | 12/1943 | Edward et al. | 211/103 X |
| 3,486,632 | 12/1969 | Balch | 248/221.11 |
| 4,113,109 | 9/1978 | Donnelli et al. | 248/220.22 X |
| 4,138,019 | 2/1979 | Smith | 248/220.31 X |
| 4,155,461 | 5/1979 | Young, Jr. | 248/220.21 X |
| 4,401,222 | 8/1983 | Kulikowski et al. | 211/103 X |
| 4,828,120 | 5/1989 | Beil et al. | 211/88 |
| 4,881,349 | 11/1989 | Brown et al. | 52/127.11 |
| 5,101,989 | 4/1992 | Jones | 248/220.22 X |
| 5,110,080 | 5/1992 | Rieman | 211/94 X |
| 5,167,391 | 12/1992 | Simpson | 248/220.21 |
| 5,277,005 | 1/1994 | Hellwig et al. | 52/220.1 |
| 5,301,477 | 4/1994 | Rellinger et al. | 248/220.21 X |
| 5,375,802 | 12/1994 | Branham, II | 248/221.11 |
| 5,400,560 | 3/1995 | Hellwig et al. | 52/578 |
| 5,535,972 | 7/1996 | Fallago | 248/220.22 |

*Primary Examiner*—Daniel P. Stodola
*Assistant Examiner*—Richard M. Smith
*Attorney, Agent, or Firm*—Webb Ziesenheim Logsdon Orkin & Hanson, P.C.

[57] ABSTRACT

A mounting bracket for mounting a binder bin on a wall panel in an office panel system has an upper end, a lower end, an elongated outer member has a base with opposed parallel edges and spaced parallel legs extending at a right angle from the base. An elongated inner member having a base with opposed parallel edges and spaced parallel legs is located within the outer member. The inner member includes a plurality of spaced slots in the base for receiving hook connectors on a binder bin end wall. A connector is located on one end of the inner member for connecting the upper end of the mounting bracket to a wall panel and a lock is located on the opposite end for locking the lower end of the mounting bracket to a wall panel. The lock includes a threaded bolt connected to the base of the outer member.

12 Claims, 3 Drawing Sheets

BINDER BIN MOUNTING BRACKET

BACKGROUND OF THE INVENTION

1. Field of the Invention

The invention relates generally to a mounting bracket for use with office panels and, in particular, to a hanging mounting bracket for mounting a Steelcase or Haworth binder bin or shelf unit on a Teknion panel in an office panel system.

2. Description of Related Art

Free-standing office panel systems are well known in the art for creating office units of varying sizes and shapes in a large open area. Such panel systems are manufactured by Teknion Furniture Systems located in Downsview, Canada; Steelcase Inc. in Grand Rapids, Mich.; and Haworth Inc. in Holland, Mich. Examples of Teknion panels for use in office panel systems are disclosed in U.S. Pat. Nos. 4,881,349 and 5,277,005. Additionally, various auxiliary items such as shelving, work station desks and binder bins are manufactured for mounting on the panels.

The Teknion office panel system provides raceways for electrical wires and data and information cabling throughout the system. The wiring and the cabling raceways are located at desk height which is very desirable because of quick and convenient accessibility to the workers.

SUMMARY OF THE INVENTION

The mounting bracket of the invention is for mounting either a Steelcase or a Haworth binder bin or shelf unit on a Teknion panel. The mounting bracket is designed to be connected to a Teknion panel at any location along the lateral length of the panel where it is desired to mount one or more binder bins or shelf units. Two brackets are required to support the opposite ends of a binder bin or a shelf unit. If adjacent binder bins are to be mounted on a panel, a single mounting bracket can be utilized for the adjacent edges of the adjacent binder bins, if desired.

The mounting brackets make it possible to mount binder bins and shelf units manufactured by Steelcase or Haworth on Teknion panels which is advantageous because Steelcase and Haworth binder bins and shelf units can be remanufactured and reused at a small portion of the cost of purchasing a new binder bin or shelf unit. The use of a remanufactured Steelcase or Haworth binder bin or shelf unit results in a significant cost savings for an office having Teknion wall panels. It will be understood by one skilled in the art that the mounting brackets can also be used to mount new binder bins or shelf units manufactured by Steelcase or Haworth on Teknion panels. Since most workstations have at least one binder bin and/or shelf unit, it is readily apparent that the mounting brackets are an integral part of an office panel system.

A complete understanding of the invention will be obtained from the following description when taken in connection with the accompanying drawings wherein like reference characters identify like parts throughout.

DESCRIPTION OF THE PREFERRED EMBODIMENT

Figure 1:
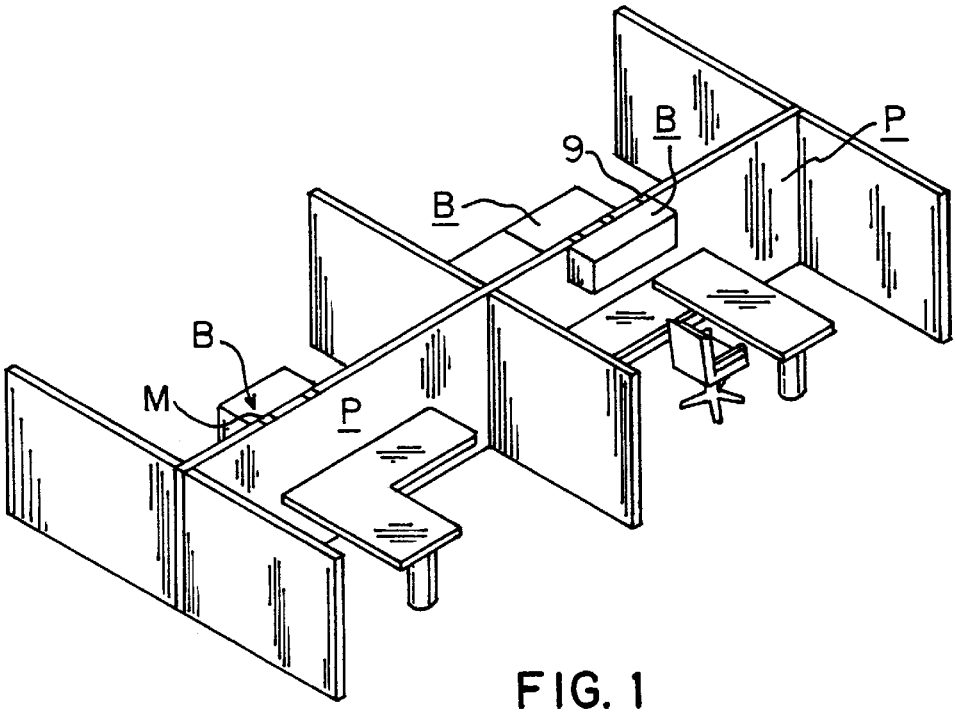
FIG. 1 is a perspective view of a wall panel system.
Figure 2:
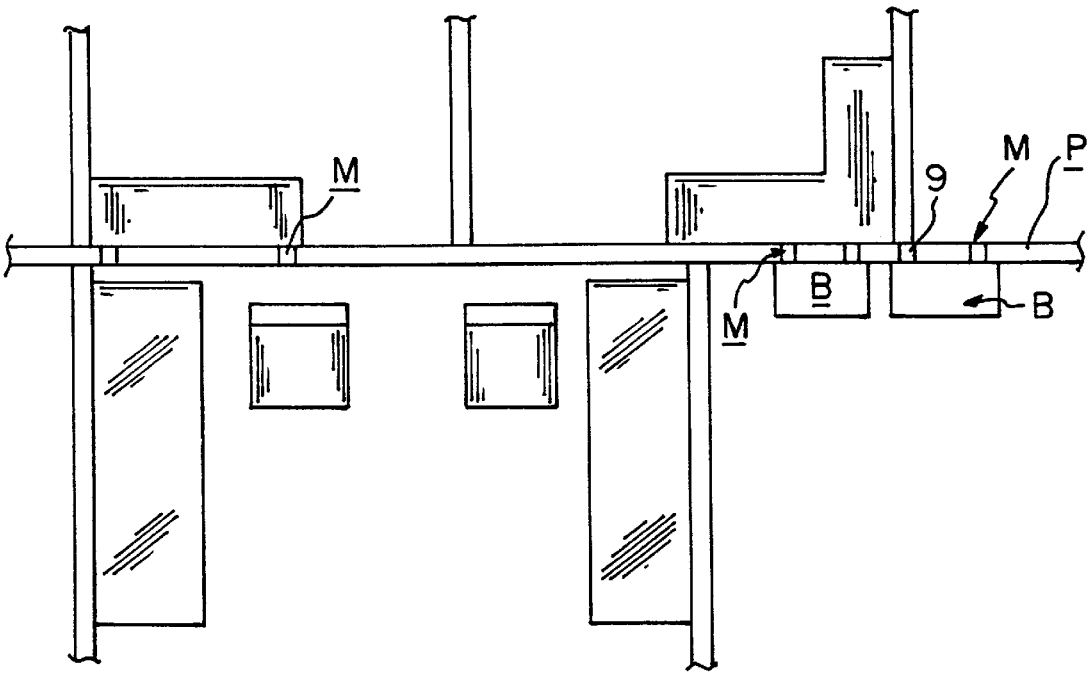
FIG. 2 is a plan view of a panel system.
Figure 5:
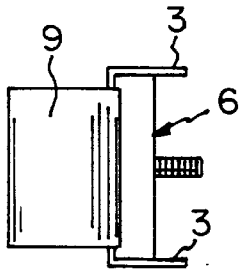
FIG. 5 is a top view of the mounting bracket shown in FIG. 3.
Figure 6:
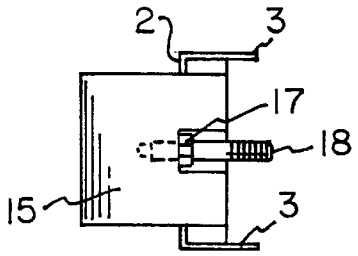
FIG. 6 is a bottom view of the mounting bracket shown in FIG. 3.

With reference to FIGS. 1 and 2 of the drawings, the binder bins B are supported on wall panels P by the mounting brackets M. The panels P are manufactured by Teknion Furniture Systems and are provided with desktop height raceways for electrical wiring and computer and data cabling for easy access.

Figure 7:
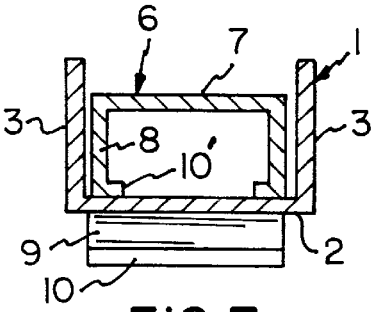
FIG. 7 is a section on line VII—VII of FIG. 3.
Figure 4:
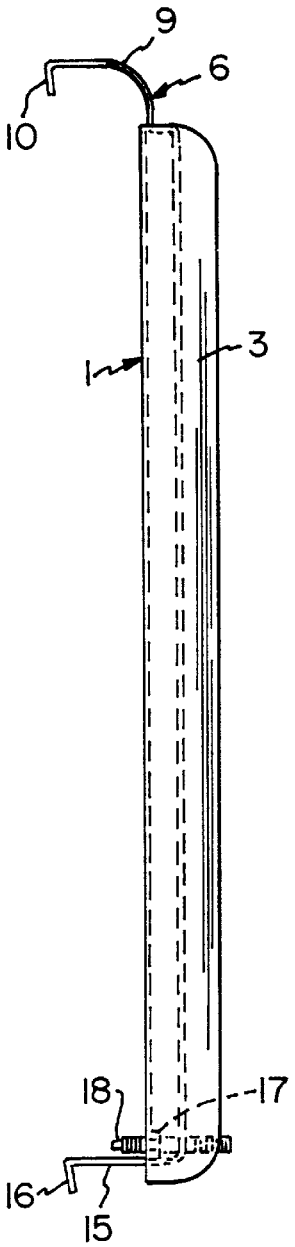
FIG. 4 is a side elevation of the mounting bracket shown in FIG. 3.
Figure 3:
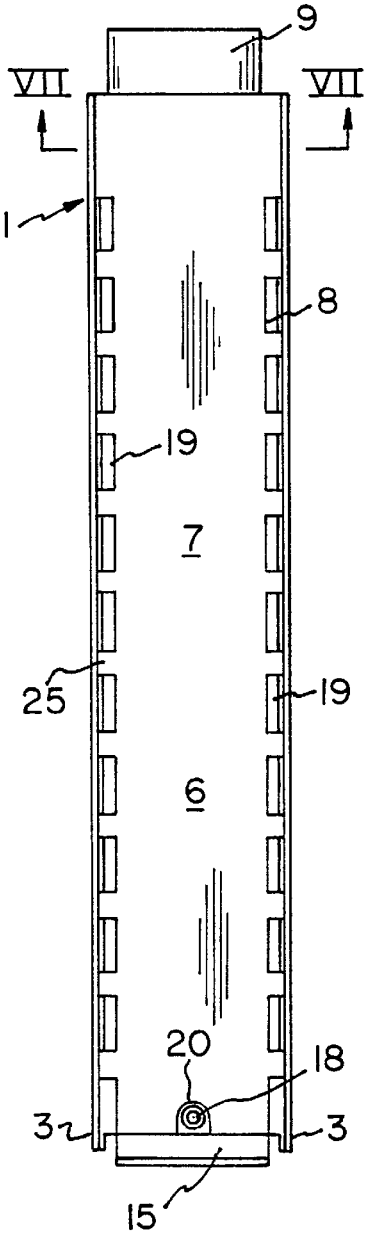
FIG. 3 is a front elevation of a mounting bracket.
Figure 8:
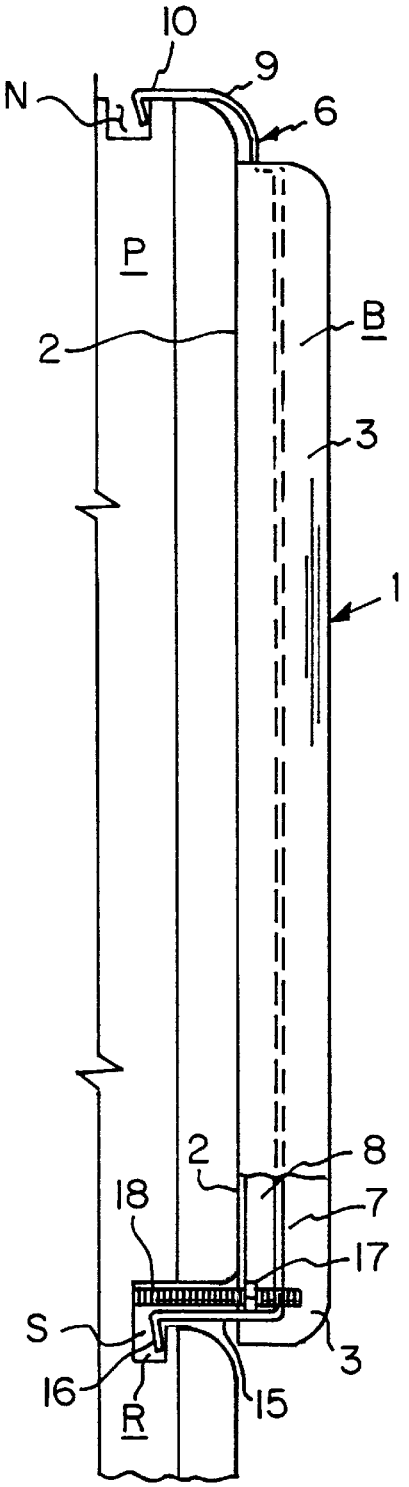
FIG. 8 is a side view of a mounting bracket on a Teknion wall panel.

The mounting bracket M has an elongated U-shaped outer channel member 1 with a base 2 having an exterior surface adapted to contact a surface of a Teknion wall panel P and spaced opposed substantially parallel legs 3 located at a right angle to the base 2. An elongated U-shaped inner channel member 6 is located between the legs 3 of the U-shaped outer channel member 1. The U-shaped inner channel member 6 has a base 7 and spaced opposed substantially parallel legs 8 located at a right angle to the base 7 with right angle feet 10 which are welded to the inner surface of the base 2 of U-shaped outer channel member 1 between the parallel legs 2 as shown in FIG. 7 of the drawings. A plurality of elongated, spaced slots 19 are formed along the opposite edges of the base 7 of the U-shaped inner channel member to receive the hook connectors on the mounting edge of a side wall W of a Steelcase or Haworth binder bin. One end of the U-shaped inner channel member 6 is formed with an extension which extends past the end of the U-shaped outer channel member 1 and is formed with a curved portion 9 and a hook 10 to embrace the upper exterior edge of a Teknion panel as shown in FIG. 8 of the drawings. This hook 10 fits into an elongated open top notch N in the upper edge of the panel P and an end cap (not shown) is placed over the upper edge of the panel to cover the hooks of the extensions of the brackets so that they are not visible to the user.

The other end of the U-shaped inner channel member 6 is formed with a right angle leg 15 extending rearwardly past the edge of the U-shaped outer channel member 1, and a hook 16 is formed on the distal edge of the right angle leg 15. The hook 16 engages a slot S formed in the panel P as shown in FIG. 8 of the drawings when the bracket is in place on a panel. An opening is formed in the edge of the base 2 of the U-shaped outer channel member 1 and an internally threaded nut 17 is welded onto the inner surface of base 2 at the opening. A threaded Allen bolt 18 extends through the nut 17 and through an opening 20 in the base 7 of U-shaped inner channel member 6 to provide access to the recessed Allen wrench opening in the end of the Allen bolt. The Allen bolt functions as a locking bolt as described hereinafter.

As shown in FIG. 8 of the drawings, a mounting bracket M is assembled on a Teknion panel P. The curved portion 9 of the bracket M extends over the front edge of the top of the panel and the hook 10 extends downwardly at a slight angle into a notch N formed in the top of the panel P. The right angle leg 15 on the lower end of the U-shaped inner channel member 6 extends through the slot S in the panel and the hook 16 extends downwardly at a slight angle into a recess R below the slot S. The threaded Allen bolt 18 extends above the upper surface of right angle leg 15 and below the lower surface of the panel which forms the top of slot S to prevent the hook 16 from disengaging from the vertical wall of the recess R to prevent the upper hook 10 from releasing from the notch N in the upper edge of the panel.

Figure 9:
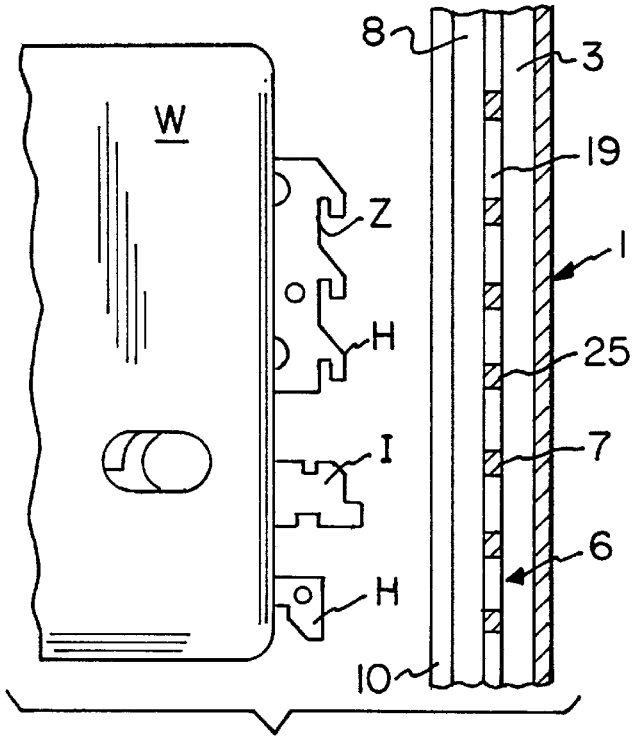
FIG. 9 is an exploded view of an end wall of a Steelcase or Haworth binder bin and a partial section of a mounting bracket.

FIG. 9 shows a broken away portion of an end wall W of a binder bin B. It will be seen that the spacing of the slots 19 in the bracket M is the same as the spacing of the hook connectors H on the end wall W of the binder bin B. Therefore, when the hook connectors H on the spaced end walls W of a binder bin B are fitted into the slots 19 on the bracket M, the hook connectors will drop into place so that the notches Z behind the hook connectors receive the edges of the slot separations 25 in the base 7 of the U-shaped inner channel member 6. The intermediate hook member I on the end wall W of the binder bin is a spring loaded locking member which is inserted into the aligned slot 25 by means of a spring loaded plate and snaps upwardly to hold the binder bin wall W on the bracket M.

It will be understood that if laterally immediately adjacent Steelcase or Haworth binder bins B are to be mounted on one or more Teknion panels P, two brackets can be placed laterally adjacent to each other so that the hook connectors H on the end walls W of the adjacent binder bins fit into the slots 19 which are located next to the adjacent edges of the adjacent bracket members M. Alternatively, a single mounting bracket M may be used to receive the hook connectors H on the immediately adjacent end walls W of two adjacent binder bins B by mounting the hook connectors on the edge of the wall W of one binder bin B in the right-hand set of slots 19 and mounting the hook connectors H on the end wall W of the adjacent binder bin B in the left-hand row of slots 19. This arrangement creates a very small space between the outer end surfaces of the immediately adjacent binder bins.

While a single embodiment of the invention has been described in detail herein, it will be understood by those skilled in the art that additional modifications and alternatives to the described embodiment can be developed in light of the overall teachings of the disclosure. Accordingly, the particular embodiment shown in the drawings is illustrative only and is not limiting as to the scope of the invention which is to be given the full breadth of the appended claims and any and all equivalents thereof.

I claim:

1. A mounting bracket for mounting a binder bin having end walls with hook connectors between the ends of a wall panel in an office panel system, said mounting bracket having an upper end, a lower end, an elongated generally U-shaped outer channel member having a base with opposed substantially parallel edges and spaced substantially parallel legs extending at a right angle from said opposed edges of said base and an elongated generally U-shaped inner channel member having a base with opposed substantially parallel edges and spaced substantially parallel legs connected to said substantially parallel edges of said base, said U-shaped inner channel member located between said spaced legs of said U-shaped outer channel member, said U-shaped inner channel member including a plurality of spaced slots in said base for receiving hook connectors on a binder bin end wall, a connecting means on said upper end of said mounting bracket for connecting said upper end of said mounting bracket to a wall panel and a locking means on said lower end of said mounting bracket for locking said lower end of said mounting bracket to a wall panel, said locking means including an adjustable locking member adjustably connected to said base of said U-shaped outer channel member, wherein said locking member is adapted to engage the wall panel to prevent disengagement of said mounting bracket relative to the wall panel, wherein said locking means includes a right angle leg extending from said base of said U-shaped inner channel member and having a distal end and a hook depending from said distal end of said right angle leg and adapted to fit into a slot in a wall panel member and wherein said adjustable locking member is adapted to fit into the slot adjacent to said right angle leg to maintain said hook in place on the wall panel.

2. A mounting bracket as set forth in claim 1 wherein said spaced slots are located adjacent to each of said opposed substantially parallel edges of said base and each slot adjacent to one of said edges is located opposite from a slot adjacent to the other of said edges to form pairs of slots on said base.

3. A mounting bracket as set forth in claim 1 wherein said locking means includes a threaded nut fixed to said base of said U-shaped outer channel member to receive said adjustable locking member, whereby said adjustable locking member is longitudinally adjusted relative to said nut.

4. A mounting bracket as set forth in claim 1 wherein said connecting means on said upper end of said mounting bracket is a curved portion of said base of said U-shaped inner channel member having a distal edge and a hook extending from said distal edge of said curved portion adapted to fit within a notch in the upper edge of a wall panel.

5. A mounting bracket for mounting a binder bin having end walls and hook connectors between the ends of a wall panel in an office panel system, said mounting bracket having an upper end, a lower end, an elongated member having a base and support means for receiving hook connectors on a binder bin, said support means attached to said elongated member and including a plurality of spaced slots for receiving hook connectors on a binder bin, connecting means on said mounting bracket for connecting said mounting bracket to a wall panel and locking means on said mounting bracket for locking said mounting bracket to a wall panel, said locking means including an adjustable locking member connected to said elongated member, wherein said locking member is adapted to engage the wall panel to prevent disengagement of said mounting bracket relative to the wall panel, wherein said support means includes opposed edges and said spaced slots are located adjacent to each of said opposed edges and each slot adjacent to one of said edges is located opposite from a slot adjacent to the other of said edges to form pairs of slots along said elongated member, wherein said locking means includes a right angle leg extending from said elongated member and having a distal end and a hook depending from said distal end of said right angle leg and adapted to fit into a slot in a wall panel member, and wherein said threaded locking member is adapted to fit into the slot adjacent to said right angle leg to maintain said hook in place on the wall panel.

6. A mounting bracket for mounting a binder bin having end walls and hook connectors between the ends of a wall panel in an office panel system, said mounting bracket having an upper end, a lower end, an elongated member having a base and support means for receiving hook connectors on a binder bin, said support means attached to said elongated member and including a plurality of spaced slots for receiving hook connectors on a binder bin, connecting means on said mounting bracket for connecting said mounting bracket to a wall panel and locking means on said mounting bracket for locking said mounting bracket to a wall panel, said locking means including an adjustable locking member connected to said elongated member, wherein said locking member is adapted to engage the wall panel to prevent disengagement of said mounting bracket relative to the wall panel and wherein said locking means includes a threaded nut fixed to said base of said elongated member to receive said adjustable locking member, whereby said adjustable locking member is adapted to fit into a slot in a wall panel to prevent movement of the mounting bracket relative to the wall panel.

7. A mounting bracket as set forth in claim 6 wherein said support means includes opposed edges and said spaced slots are located adjacent to each of said opposed edges and each slot adjacent to one of said edges is located opposite from a slot adjacent to the other of said edges to form pairs of slots along said elongated member.

8. A mounting bracket as set forth in claim 6 wherein said connecting means is on said upper end of said mounting bracket and is a curved portion of said support means having a distal edge and a hook extending from said distal edge of said curved portion adapted to fit within a notch in the upper edge of a wall panel.

9. A mounting bracket for mounting a construct having at least one substantially vertical wall with hook connectors between the ends of a wall panel in an office panel system, said mounting bracket having an upper end, a lower end, an elongated outer channel member having a base with opposed substantially parallel edges and spaced substantially parallel legs and an elongated inner channel member having a base with opposed substantially parallel edges and spaced substantially parallel legs attached to said base, said inner channel member located between said legs of said outer channel member, said inner channel member including a plurality of spaced slots in said base of said inner channel member for receiving hook connectors on a construct wall, a connecting means on said mounting bracket for connecting said mounting bracket to a wall panel and a locking means on said mounting bracket for locking said mounting bracket to a wall panel, said locking means including an adjustable locking member connected to said base of said outer channel member, wherein said locking member is adapted to engage the wall panel to prevent disengagement of said mounting bracket relative to the wall panel, wherein said locking means includes a leg extending from said base of said inner channel member and having a distal end and a hook depending from said distal end of said leg and adapted to fit into a slot in a wall panel member, and wherein said locking member is adapted to fit into the slot adjacent to said leg to maintain the mounting bracket in place on the wall panel.

10. A mounting bracket as set forth in claim 9, wherein said locking means includes means fixed to said base of said outer channel member for receiving said adjustable locking member, wherein said adjustable locking member is longitudinally adjustable relative to said receiving means.

11. A mounting bracket as set forth in claim 9 wherein said connecting means is on said upper end of said mounting bracket and is a curved portion of said inner channel member having a distal edge and a hook extending from said distal edge of said curved portion adapted to fit within a notch in the upper edge of a wall panel.

12. A mounting bracket as set forth in claim 9, wherein said spaced slots are located along each of said opposed substantially parallel edges of said base and each slot on one of said edges is located opposite from a slot on the other of said edges to form pairs of slots along said base.

* * * * *